US009851659B2

(12) United States Patent
Fujita

(10) Patent No.: US 9,851,659 B2
(45) Date of Patent: Dec. 26, 2017

(54) TRANSFER DEVICE, NON-TRANSITORY COMPUTER READABLE MEDIUM, IMAGE FORMING APPARATUS, AND TRANSFER METHOD

(71) Applicant: FUJI XEROX CO., LTD., Tokyo (JP)

(72) Inventor: Tetsuya Fujita, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/239,017

(22) Filed: Aug. 17, 2016

(65) Prior Publication Data

US 2017/0242374 A1 Aug. 24, 2017

(30) Foreign Application Priority Data

Feb. 19, 2016 (JP) ..... 2016-030082

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS 5,805,957 A * 9/1998 Kodama ..... G03G 15/165 399/121
5,966,559 A * 10/1999 May ..... G03G 15/167 399/303
2009/0175641 A1 7/2009 Mizushima et al.
2009/0279918 A1 11/2009 Sendo et al.
2010/0221029 A1* 9/2010 Minbu ..... G03G 15/0131 399/66

FOREIGN PATENT DOCUMENTS

JP 2007-121333 A 5/2007
JP 2009-175696 A 8/2009
JP 4706718 B2 6/2011

* cited by examiner

*Primary Examiner* — G. M. Hyder
(74) *Attorney, Agent, or Firm* — Oliff PLC

(57) ABSTRACT

A transfer device includes a transport belt that contacts with a photoreceptor, and transports a recording medium; a transfer roll that transfers the toner image formed on a surface of the photoreceptor to the recording medium while pressing the recording medium to the photoreceptor through the transport belt; an adjusting unit that adjusts a pressing force of the transfer roll against the recording medium; and a controller that controls the adjusting unit so that a first pressing force is stronger than a second pressing force. The first pressing force is the pressing force after the recording medium starts to pass through a transfer position of the transfer roll and is moved by a predetermined distance. The second pressing force is the pressing force when the recording medium starts to pass through the transfer position.

12 Claims, 10 Drawing Sheets

(CONT.)

(FIG. 10 CONTINUED)
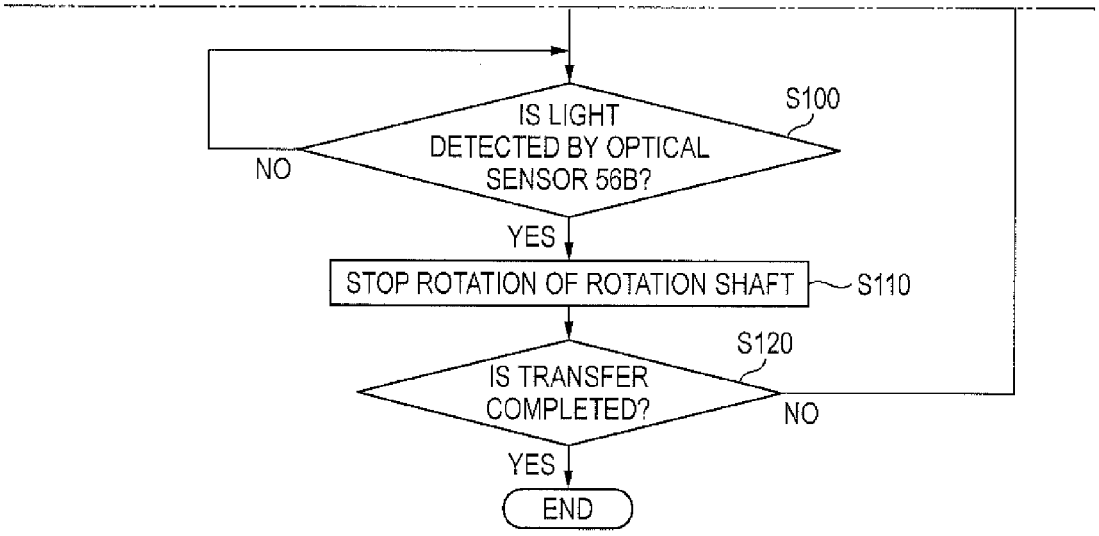

TRANSFER DEVICE, NON-TRANSITORY COMPUTER READABLE MEDIUM, IMAGE FORMING APPARATUS, AND TRANSFER METHOD

CROSS-REFERENCE TO RELATED APPLICATIONS

This application is based on and claims priority under 35 USC 119 from Japanese Patent Application No. 2016-030082 filed Feb. 19, 2016.

BACKGROUND

Technical Field

The present invention relates to a transfer device, a non-transitory computer readable medium, an image forming apparatus, and a transfer method.

SUMMARY

According to an aspect of the invention, a transfer device includes:

a transport belt that contacts with a photoreceptor including a surface on which a toner image is formed, and transports a recording medium;

a transfer roll that transfers the toner image formed on the surface of the photoreceptor to the recording medium while pressing the recording medium to the photoreceptor through the transport belt;

an adjusting unit that adjusts a pressing force of the transfer roll against the recording medium; and a controller that controls the adjusting unit so that a first pressing force is stronger than a second pressing force, wherein the first pressing force is the pressing force after the recording medium starts to pass through a transfer position of the transfer roll and is moved by a predetermined distance, and the second pressing force is the pressing force when the recording medium starts to pass through the transfer position.

BRIEF DESCRIPTION OF THE DRAWINGS

Exemplary embodiments of the present invention will be described in detail based on the following figures, wherein.

DETAILED DESCRIPTION

Figure 1:
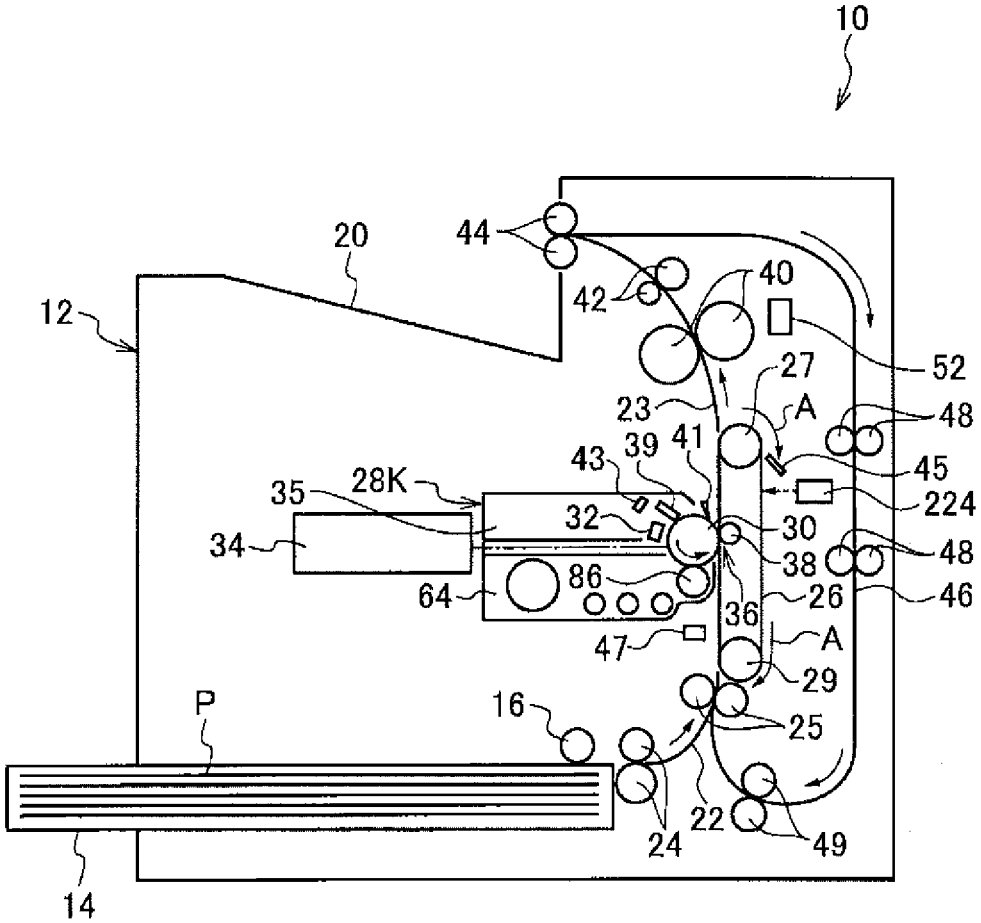
FIG. 1 is a diagram showing a configuration example of an image forming apparatus.

Hereinafter, embodiments for realizing the invention will be described in detail with reference to the drawings. In addition, the same reference numerals are used for constituent elements performing the same operations and functions in all of the drawings and the description will be omitted for the overlapped parts.

Overall Configuration

First, a configuration of an image forming apparatus 10 according to the exemplary embodiment will be described with reference to FIG. 1. The image forming apparatus 10 includes an image forming apparatus main body 12, and a paper feeding unit 14 in which plural sheets of paper P which is an example of a recording medium are laminated and accommodated in a bundle form, in a lower portion of the image forming apparatus main body 12.

A pickup roll 16 which is in pressure contact with the paper P and transfers the paper P from the paper feeding unit 14 is disposed right above the paper feeding unit 14 on a front end side (right end side in FIG. 1).

A transport roll pair 24 which nips and transports the paper P and a registration roll pair 25 for skew correction of the paper P are disposed on the downstream side of the pickup roll 16. A first transporting path 22 which is extended from the gap between the transport roll pair 24 and curved upwards, and extends to the gap between the registration roll pair 25 is formed between the transport roll pair 24 and the registration roll pair 25.

The paper P transported from the paper feeding unit 14 passes through the first transporting path 22 and is temporarily stopped by the registration roll pair 25. Then, the paper P is loaded on a transport belt 26 which will be described later at a predetermined timing and transported to a gap formed with a photoreceptor 30 and a transfer roll 38 which rotate.

A position sensor 47 which detects presence and absence of the paper P transported through the transport belt 26 is installed on the upstream side of the transfer roll 38 in a transporting direction of the paper P, to oppose the transport belt 26.

Hereinafter, the gap formed with the photoreceptor 30 and the transfer roll 38 is referred to as a "transfer gap 36".

The transport belt 26 is an endless belt containing at least a material such as rubber having elasticity of expanding and contracting in the transporting direction of the paper P. The transport belt is, for example, stretched using a tension roll 27 disposed on the upper portion of the image forming apparatus main body 12 and a tension roll 29 disposed on the lower portion thereof. The transport belt 26, for example, rotates in a predetermined direction (arrow A direction) and transports the paper P, due to the rotation of one of the tension roll 27 and the tension roll 29.

A blade 45 is installed so as to be in contact with the surface of the transport belt 26, ahead of a position where the transport belt 26 is folded back toward a direction opposite to the transporting direction of the paper P through the tension roll 27. The blade 45 removes a toner attached to the surface of the transport belt 26.

Meanwhile, a process cartridge 28K corresponding to a black color is, for example, disposed to oppose the transport belt 26 in a horizontal direction. The process cartridge 28K includes a photoreceptor unit 35, and a developing device 64 including a developing roll 86.

The photoreceptor unit 35, for example, includes the photoreceptor 30, a charging device 32, a finger 41, a cleaning device 39, and a charge eliminating device 43.

The charging device 32, for example, contains a charge corotron and, for example, negatively charges the surface of the photoreceptor 30.

An exposure device 34 is installed beside the process cartridge 28K. The exposure device 34 emits laser to the photoreceptor 30 which is charged by the charging device 32 to remove the negative charges, and forms a positive electrostatic latent image corresponding to an image desired to be formed by a user (user image) on the photoreceptor 30.

The developing roll 86 is installed in the developing device 64 so as to contact with the photoreceptor 30 and the negatively-charged toner which is supplied from the inner portion of the developing device 64 is attached to the surface thereof. The developing roll 86 attaches the toner attached to the surface, to the electrostatic latent image formed on the photoreceptor 30 in accordance with the rotation of the photoreceptor 30. Accordingly, the electrostatic latent image on the photoreceptor 30 is developed and a toner image is formed. In the exemplary embodiment, the color of the toner is assumed to be black in the description, unless otherwise noted regarding the color.

The finger 41 is, for example, attached to the photoreceptor unit 35 so that one end thereof contacts with the surface of the photoreceptor 30. When the paper P passes through the transfer gap 36, the paper P is nipped between the photoreceptor 30 and the transfer roll 38 together with the transport belt 26, and in this case, the paper P may be peeled from the transport belt 26 to which the paper P is electrostatically adsorbed and the paper may be attached to the photoreceptor 30, due to a force of the transfer roll 38 pressing the paper P against the photoreceptor 30, that is, a pressing force.

The finger 41 peels the paper P attached to the photoreceptor 30 from the photoreceptor 30 and returns to the upper portion of the transport belt 26.

In the same manner as the finger 41, the cleaning device 39 is attached to the photoreceptor unit 35, for example, so that one end thereof contacts with the surface of the photoreceptor 30, and removes residual toner attached to the photoreceptor 30 after the toner image is transferred to the paper P.

The charge eliminating device 43 removes the residual charges on the photoreceptor 30, after the toner image is transferred to the paper P. An erase lamp which emits light to the photoreceptor 30 to remove the residual charges on the photoreceptor 30 is an example of the charge eliminating device 43.

Meanwhile, a second transporting path 23 which introduces the paper P transported with the transport belt 26 to an exit unit 20 is formed on the downstream side of the transport belt 26 in the paper transporting direction. A fixing device 40 which fixes the toner image transferred to the paper P, to the paper P, a transport roll pair 42 which transports the paper P while nipping the paper, and an exit roll pair 44 which outputs the paper P to the exit unit 20 are disposed on the second transporting path 23.

The fixing device 40 includes a heat source, and performs heating while pressurizing the paper P to which the toner image is transferred, to fix the toner image to the paper P. The fixing device 40 is installed so that a distance between the fixing device 40 and the transfer roll 38 is as short as possible, in order to reduce the size of the image forming apparatus 10. Accordingly, with respect to the same paper P, the fixing of the transferred toner image may be performed by the fixing device 40, while performing transfer of the toner image by the transfer roll 38.

A third transporting path 46 for returning the paper P switched back by the exit roll pair 44 to the registration roll pair 25 is formed on a position opposing the transport belt 26, for example.

A transport roll pair 48 which transports the paper P while nipping the paper is disposed on the third transporting path 46, and the paper P in which an image is formed on one image formation surface of the paper P is switched back by the exit roll pair 44 to be introduced to the third transporting path 46, at the time of duplex printing. The paper P is transported to the third transporting path 46 by the transport roll pair 48, and the paper P is transported to the registration roll pair 25 again by a reverse roll 49, after reversing the image formation surface so that a new toner image is transferred to another image formation surface to which the toner image is not transferred yet.

Image Formation Operation

In a case of forming an image on the paper P in the image forming apparatus 10 according to the exemplary embodiment, first, the paper P extracted from the paper feeding unit 14 is transported to the registration roll pair 25 by the transport roll pair 24 and is transported to the transport belt 26 after being subjected to skew correction by the registration roll pair 25.

The paper P is transported to the transfer gap 36 in accordance with the movement of the transport belt 26.

The paper P transported to the transfer gap 36 is nipped by the photoreceptor 30 and the transfer roll 38, and the photoreceptor 30 on which the toner image is formed is pressed against the paper P. At this time, the toner image is more easily transferred to the paper P, by applying a transfer bias voltage having polarity opposite to the charging polarity of the toner to the transfer roll 38 from a power supply for transfer (not shown). Since the toner image on the photoreceptor 30 is transferred to the paper P in the transfer gap 36, the transfer gap 36 is an example of a transfer position.

The paper P to which the toner image is transferred by the transfer roll 38 is transported to the fixing device 40 and the transferred toner image is fixed onto the paper P by the fixing device 40.

In a case of forming a user image on one surface of the paper P (hereinafter, referred to as "simplex printing"), after fixing the transferred toner image to the paper P by the fixing device 40, the paper P is discharged to the exit unit 20 by the exit roll pair 44.

Meanwhile, in a case of forming a user image to both surfaces of the paper P (hereinafter, referred to as "duplex printing"), after forming the user image on one surface of the paper P, the paper P is switched back by the exit roll pair 44.

Accordingly, the image formation surface of the paper P is reversed and transported to the third transporting path 46.

In addition, the paper P is transported again to the registration roll pair 25 from the third transporting path 46 and passes through the transfer gap 36, again. Accordingly, the toner image corresponding to the user image is transferred to the other image formation surface of the paper P where the toner image is not transferred yet, by the transfer roll 38.

Details of Transfer Operation

Figure 2:
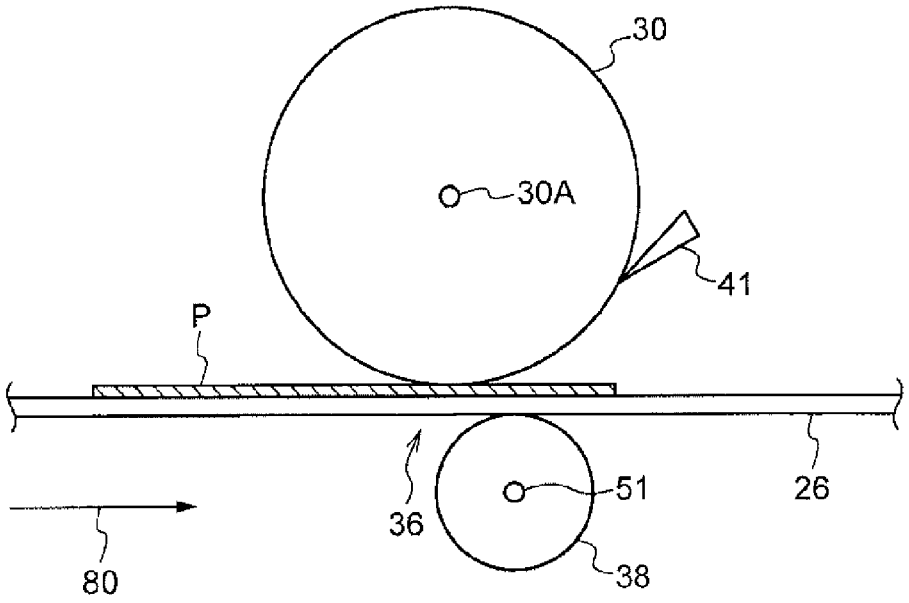
FIG. 2 is a schematic view showing an example of a transporting state of paper in a case where a pressing force of a transfer roll against a photoreceptor is weakened.
Figure 3:
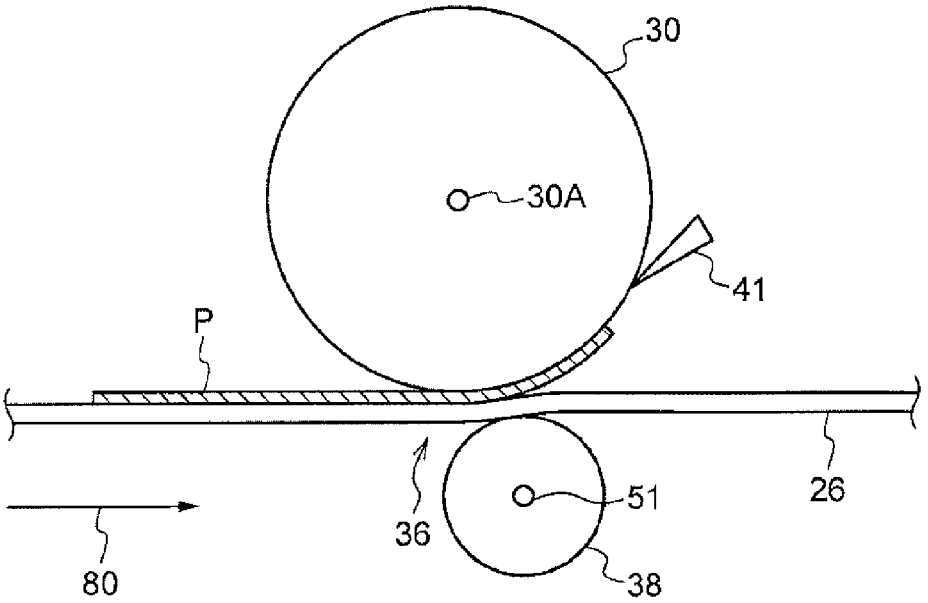
FIG. 3 is a schematic view showing an example of a transporting state of paper in a case where a pressing force of the transfer roll against the photoreceptor is strengthened.

Next, the transfer operation of the toner image to the paper P performed by the transfer roll 38 will be described in detail with reference to FIG. 2 and FIG. 3. In FIG. 2 and FIG. 3, the members necessary for the description are selected and shown from the members relating to the transfer, and thus, the charging device 32, the developing roll 86, the cleaning device 39, and the charge eliminating device 43 installed around the photoreceptor 30, for example, are omitted.

First, in the image forming apparatus 10 according to the exemplary embodiment, as shown in FIG. 2 and FIG. 3, a position of a rotation shaft 51 of the transfer roll 38 in a transporting direction of the paper P shown by an arrow 80 is disposed to be different from a position of a rotation shaft 30A of the photoreceptor 30. Specifically, the position of the rotation shaft 51 of the transfer roll 38 is disposed on the downstream side of the position of the rotation shaft 30A of the photoreceptor 30 in the transporting direction of the paper P.

Since a transfer bias voltage is applied to the transfer roll 38 when transferring the toner image to the paper P, discharging may occur between the photoreceptor 30 and the transfer roll 38, in some cases, before the paper P is nipped in the transfer gap 36.

When discharging occurs between the photoreceptor 30 and the transfer roll 38 before the paper P is nipped in the transfer gap 36, nonuniformity of density may occur in the toner image of the photoreceptor 30 due to influences of the discharging, and quality of the image formed on the paper P may be deteriorated.

However, since discharging properties change by disposing the position of the rotation shaft 51 of the transfer roll 38 to the downstream side of the position of the rotation shaft 30A of the photoreceptor 30 in the transporting direction of the paper P, the discharging occurring between the photoreceptor 30 and the transfer roll 38 before the paper P is nipped in the transfer gap 36 is prevented and a deterioration in quality of the image is prevented, compared to a case where the positions of the rotation shaft 30A of the photoreceptor 30 and the rotation shaft 51 of the transfer roll 38 in the transporting direction of the paper P are set to be the same.

The transfer roll 38 shown in FIG. 2 shows a state where the transfer roll 38 is disposed to be separated from the photoreceptor 30 within a range that the toner image is transferred to the paper P, so as to weaken a pressing force of the transfer roll 38 against the photoreceptor 30, compared to the transfer roll 38 shown in FIG. 3.

As the image forming apparatus 10 according to the exemplary embodiment, in a case where a material having elasticity is used in the transport belt 26, the transport belt 26 expands and contracts along the transporting direction of the paper P, when the transport belt 26 is stretched and moved in the transporting direction of the paper P due to the rotation of the tension roll 27. Adhesiveness between the paper P and the photoreceptor 30 decreases in accordance with the weakening of the pressing force of the transfer roll 38 against the photoreceptor 30, but in accordance with a decrease in adhesiveness between the paper P and the photoreceptor 30, a position deviation (hereinafter, referred to as "slip") of the paper P due to the expansion and contraction of the transport belt 26 easily occur in the transfer gap 36 and nonuniformity of density may be generated in the toner image due to rubbing of the paper P and the photoreceptor 30 due to the slip, for example.

The nonuniformity of density due to the slip of the paper P (hereinafter, this phenomenon is referred to as "smear") is easily generated, for example, in a case of transferring a halftone image, which expresses shades by adjusting an adhesion area of a toner on the paper P to the paper P along a width direction of the paper P. Here, the width direction of the paper P is a direction orthogonal to the transporting direction of the paper P and is specifically a direction along a rotation shaft direction of the photoreceptor 30.

Particularly, in a case of transferring the halftone image having density of 50% to the paper P, portions to which the toner is transferred and portions to which the toner is not transferred are alternately expressed at even intervals, and accordingly, when the slip of the paper P occurs and the paper P is rubbed with the photoreceptor 30, a width of a line or the like expressed by the toner changes to cause a deterioration in quality of an image.

Therefore, when the transfer roll 38 is disposed to be closer to the photoreceptor 30, compared to the case of FIG. 2, in order to the strengthening of the pressing force of the transfer roll 38 against the photoreceptor 30, the adhesiveness between the paper P and the photoreceptor 30 increases, and thus, occurrence of the slip in the transfer gap 36 is prevented.

However, by doing so, the paper P is easily attached to the photoreceptor 30 due to the pressing force, in accordance of the strengthening of the pressing force of the transfer roll 38 against the photoreceptor 30. That is, an angle between the paper P and the transport belt 26 (hereinafter, referred to as a "peeling angle") increases in accordance with the strengthening of the pressing force of the transfer roll 38 against the photoreceptor 30, and as shown in FIG. 3, peeling failure which is a phenomenon that the paper P is wound around the photoreceptor 30 occurs.

In a case where the peeling failure occurs, since a downstream end, in the transporting direction, of the paper P (hereinafter, referred to as a front end of the paper P) which is wound around the photoreceptor 30 collides with the finger 41, the paper P is peeled from the photoreceptor 30 and returns to the upper portion of the transport belt 26.

As described above, the finger 41 is disposed so as that the one end thereof contacts with the surface of the photoreceptor 30. However, since residual toner after transfer is present on the surface of the photoreceptor 30, the residual toner is attached to the end of the finger 41 contacting with the photoreceptor 30. Accordingly, dirt due to the residual toner attached to the finger may be attached to the front end of the paper P which is peeled from the photoreceptor 30 by the finger 41.

Figure 4:
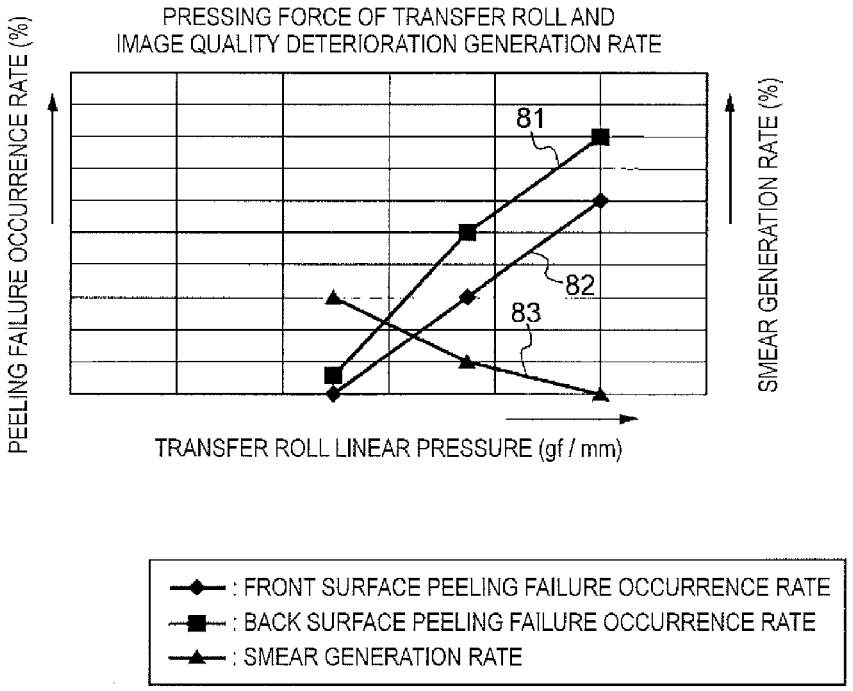
FIG. 4 is a graph showing an example of a smear generation rate and a peeling failure occurrence rate in a case where a pressing force of the transfer roll against the photoreceptor is changed.

FIG. 4 is a graph showing a generation rate of a deterioration in image quality (hereinafter, referred to as a "smear generation rate") and a peeling failure occurrence rate in a case where a pressing force of the transfer roll 38 against the photoreceptor 30 is changed. A graph 81 shows a front surface peeling failure occurrence rate, a graph 82 shows a back surface peeling failure occurrence rate, and a graph 83 shows a smear generation rate, respectively.

Here, the "front surface peeling failure occurrence rate" indicates an occurrence rate of peeling failure when executing simplex printing and the "back surface peeling failure occurrence rate" indicates art occurrence rate of peeling failure when a toner image is transferred to one image formation surface (back surface) of the paper P in which the toner image is already transferred to the other image formation surface, at the time of duplex printing.

A horizontal axis of FIG. 4 indicates linear pressure which is an example of an index showing a pressing force of the transfer roll 38 against the photoreceptor 30, and a vertical axis on the right side of FIG. 4 indicates the smear generation rate and a vertical axis on the left side thereof indicates the peeling failure occurrence rate, respectively. The linear pressure becomes strong towards the right side of the horizontal axis of FIG. 4, and the smear generation rate and the peeling failure occurrence rate increase upwardly in the vertical axis of FIG. 4.

As described above, since occurrence of the slip in the transfer gap 36 is prevented in accordance of an increase in linear pressure of the transfer roll 38, the smear generation rate decreases. Meanwhile, since the peeling angle of the paper P become large, the peeling failure occurrence rate increases.

As shown with the graph 81 and the graph 82, the back surface peeling failure occurrence rate tends to increase with respect to each linear pressure of the transfer roll 38, when the front surface peeling failure occurrence rate and the back surface peeling failure occurrence rate are compared to each other. This is may be because the paper P is more easily attached to the photoreceptor 30 in a case of transferring a toner image to the back surface, compared to a case of transferring a toner image to the front surface, due to influences applied when transferring the toner image to the paper P which has been heated once by the fixing device 40 and bending of the paper P due to the attachment of the toner to the surface.

Adjustment Mechanism of Pressing Force of Transfer Roll

Next, an adjusting device 59 which adjusts a pressing force of the transfer roll 38 of the image forming apparatus 10 according to the exemplary embodiment will be described with reference to FIG. 5 to FIG. 8.

Figure 5:
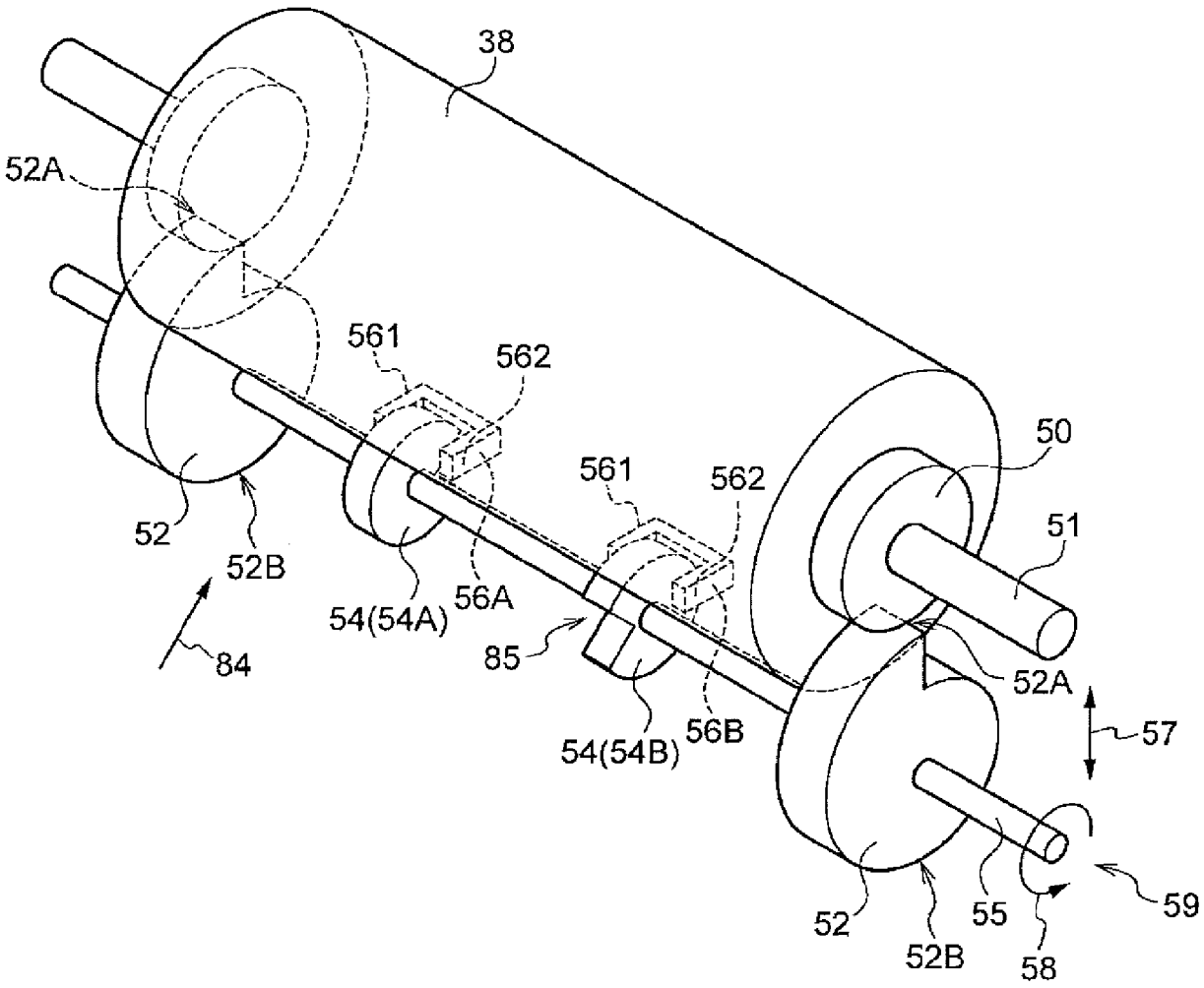
FIG. 5 is a perspective view showing an example of a schematic configuration of the transfer roll and the adjusting device.
Figure 6:
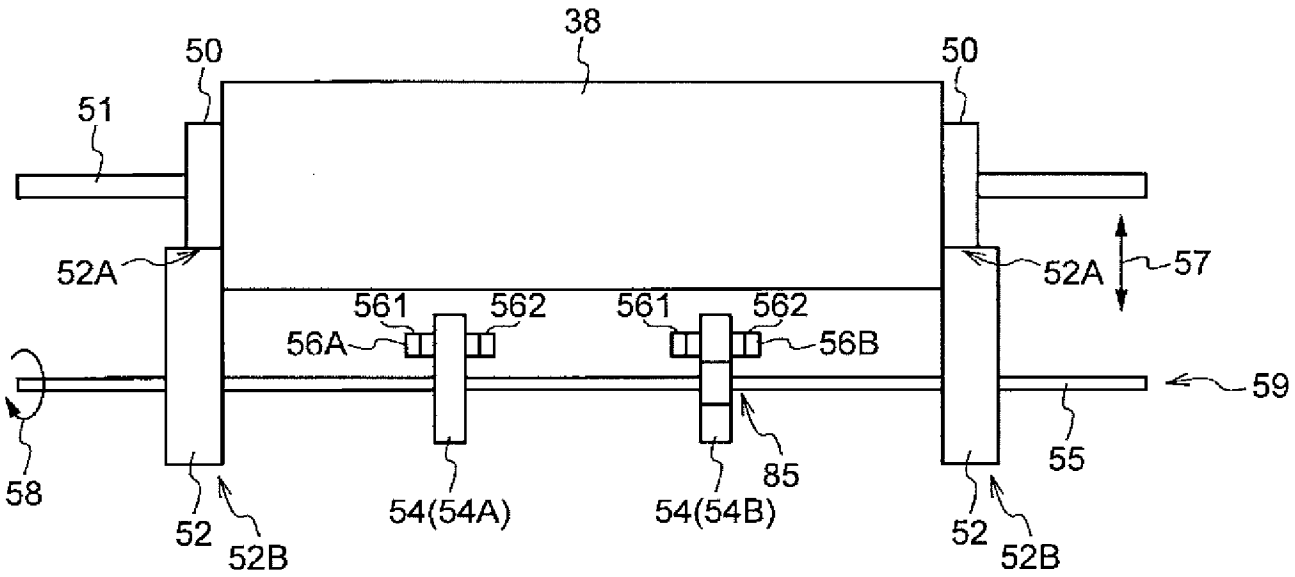
FIG. 6 is a front view showing an example of a schematic configuration of the transfer roll and the adjusting device.

FIG. 5 is a perspective view showing an example of a schematic configuration of the transfer roll 38 and the adjusting device 59, FIG. 6 is a front view showing an example of a schematic configuration of the transfer roll 38 and the adjusting device 59, when the transfer roll 38 and the adjusting device 59 is seen in a direction shown with an arrow 84 of FIG. 5.

As shown in FIG. 5 and FIG. 6, the adjusting device 59, for example, includes a rotation shaft 55, an eccentric cam 52, a light shielding plate 54, and optical sensors 56A and 56B and has a structure in which the eccentric cam 52 and the light shielding plate 54 are attached to the rotation shaft 55 which rotates in a direction of an arrow 58 by a motor (not shown).

The eccentric cam 52 has a shape in which one end of a linear portion of two semicircular body having different diameters is, for example, overlapped with an end of a linear portion of the other semicircular body. Accordingly, in the eccentric cam 52, distances between a position through which the rotation shaft 55 penetrate (hereinafter, referred to as the "center of eccentric cam 52") and peripheries of the eccentric cam 52 are different.

The eccentric cam 52 is attached to the rotation shaft 55 so as to contact with a bearing 50 which is attached to the rotation shaft 51 with the transfer roll 38 and supports the rotation shaft 51, and the eccentric cam 52 rotates in a direction of the arrow 58 in accordance with the rotation shaft 55.

In FIG. 5, among the ends of the eccentric cam 52, a portion at which the distance from the center of the eccentric cam 52 is longest is shown as a first pressing position 52A, and a portion at which the distance from the center of the eccentric cam 52 is shortest is shown as a second pressing position 52B.

The rotation shaft 55 of the adjusting device 59 is, for example, attached to the image forming apparatus main body 12 so as not to move in a direction of an arrow 57, whereas the rotation shaft 51 of the transfer roll 38 is, for example, attached to the image forming apparatus main body 12 so as to move in a direction along the arrow 57. Accordingly, when the rotation shaft 55 rotates and the first pressing position 52A of the eccentric cam 52 comes into contact with the bearing 50, the transfer roll 38 is pressed upwards of the arrow 57 and a pressing force of the transfer roll 38 against photoreceptor 30 is strengthened.

Meanwhile, when the rotation shaft 55 rotates and the second pressing position 52B of the eccentric cam 52 comes into contact with the bearing 50, the transfer roll 38 moves downwards of the arrow 57 due to the weight of the transfer roll 38, for example. Accordingly, a pressing force of the transfer roll 38 against photoreceptor 30 is weakened, compared to a case where the first pressing position 52A of the eccentric cam 52 comes into contact with the bearing 50.

Figure 7:
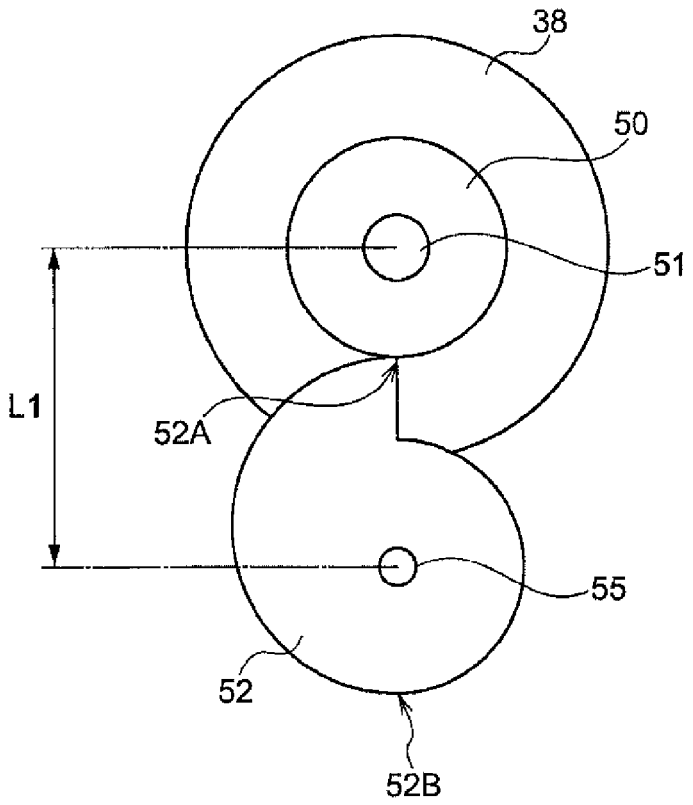
FIG. 7 is a diagram showing an example of a state of an eccentric cam, in a case where a pressing force of the transfer roll against the photoreceptor is set to a first pressing force.
Figure 8:
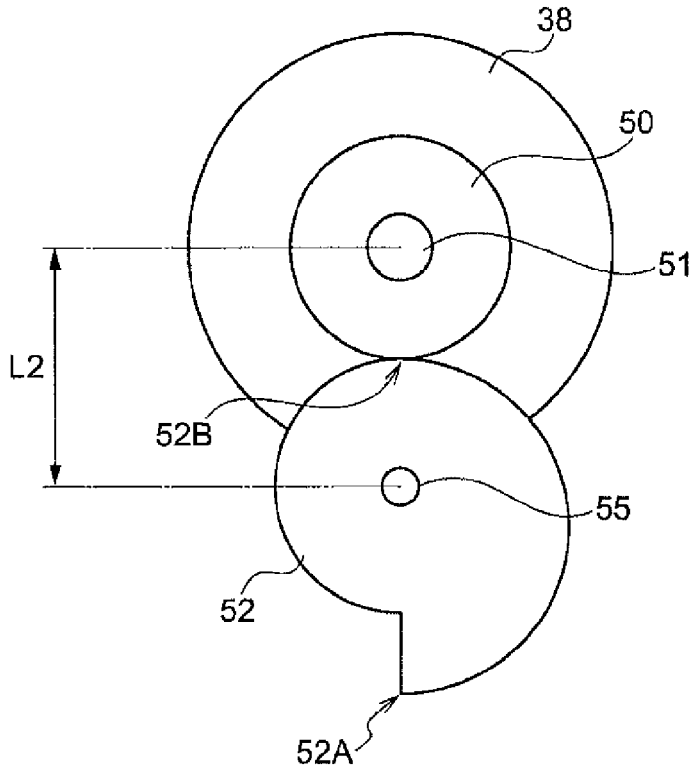
FIG. 8 is a diagram showing an example of a state of an eccentric cam, in a case where a pressing force of the transfer roll against the photoreceptor is set to a second pressing force.

FIG. 7 is a diagram showing an example of a positional relationship between the transfer roll 38 and the eccentric cam 52 in a case where the first pressing position 52A of the eccentric cam 52 comes into contact with the bearing 50, and FIG. 8 is a diagram showing an example of a positional relationship between the transfer roll 38 and the eccentric cam 52 in a case where the second pressing position 52B of the eccentric cam 52 comes into contact with the bearing 50.

Since a distance L1 between the rotation shaft 51 of the transfer roll 38 and the rotation shaft 55 of the adjusting device 59 in FIG. 7 is longer than a distance L2 between the rotation shaft 51 of the transfer roll 38 and the rotation shaft 55 of the adjusting device 59 in FIG. 8, the pressing force of the transfer roll 38 against the photoreceptor 30 in a case where the first pressing position 52A of the eccentric cam 52 comes into contact with the bearing 50 becomes stronger than the pressing force of the transfer roll 38 against the photoreceptor 30 in a case where the second pressing position 52B of the eccentric cam 52 comes into contact with the bearing 50.

Hereinafter, the pressing force of the transfer roll 38 against the photoreceptor 30 in a case where the first pressing position 52A of the eccentric cam 52 comes into contact with the bearing 50 is referred to as a "first pressing force" and the pressing force of the transfer roll 38 against the photoreceptor 30 in a case where the second pressing position 52B of the eccentric cam 52 comes into contact with the bearing 50 is referred to as a "second pressing force".

The two U-shaped optical sensors 56A and 56B each including two projections 561 and 562 are provided around the rotation shaft 55 so that openings formed with the projection 561 an the projection 562 oppose the rotation shaft 55, and the two light shielding plates 54 are attached to the rotation shaft 55 so as to pass through the openings of the optical sensors 56A and 56B.

Among the two projections 561 and 562 of the U-shaped optical sensors 56A and 56B, a light emitting element such as a light emitting diode which emits light to the projection 562 is attached to the projection 561 and a light receiving element such as a phototransistor which detects light is attached to the projection 562.

As shown in FIG. 5, the light shielding plate 54 has a defective part 85 which is formed when a part of a disk is chipped in an arch shape. Accordingly, in a case where the light shielding plates 54 rotate in accordance with the rotation of the rotation shaft 55 and the defective parts 85 of the light shielding plates 54 pass through the openings of the optical sensors 56A and 56B, the optical sensors 56A and 56B may detect light emitted from the light emitting element attached to the projection 561 of the optical sensors 56A and 56B using the light receiving element attached to the projection 562. Meanwhile, in a case where the portion other than the defective parts 85 of the light shielding plates 54 pass through the openings of the optical sensors 56A and 56B, light emitted to the optical sensors 56A and 56B from the light emitting element attached to the projection 561 of the optical sensors 56A and 56B is shielded by the light shielding plates 54, and accordingly, the light may not be detected by the light receiving element attached to the projection 562.

Here, for convenience of description, among the two light shielding plates 54 attached to the rotation shaft 55, one light shielding plate 54 is shown as the "light shielding plate 54A" and the other light shielding plate 54 is shown as the "light shielding plate 54B". In a case where it is not necessary to distinguish the two light shielding plates 54, these are simply shown as the "light shielding plate 54".

As shown in FIG. 5, the light shielding plate 54A is attached to the rotation shaft 55 so that the first pressing position 52A of the eccentric cam 52 comes into contact with the bearing 50, in a case where the defective part 85 of the light shielding plate 54A passes through the opening of the optical sensor 56A. Meanwhile, the light shielding plate 54B is attached to the rotation shaft 55 so that the second pressing position 52B of the eccentric cam 52 comes into contact with the bearing 50, in a case where the defective part 85 of the light shielding plate 54B passes through the opening of the optical sensor 56B. In the light shielding plate 54, the shape of the defective part 85 is determined so as not to detect the light from the optical sensors 56A and 56B at the same time.

Therefore, a case where the light is detected by the optical sensor 56A where the light is shielded by the light shielding plate 54A indicates that the first pressing position 52A of the eccentric cam 52 is positioned to come into contact with the bearing 50, and a case where the light is detected by the optical sensor 56B where the light is shielded by the light shielding plate 54B indicates that the second pressing position 52B of the eccentric cam 52 is positioned to come into contact with the bearing 50.

Next, constituent elements of an electric system of the image forming apparatus 10 according to the exemplary embodiment will be described with reference to FIG. 9.

Figure 9:
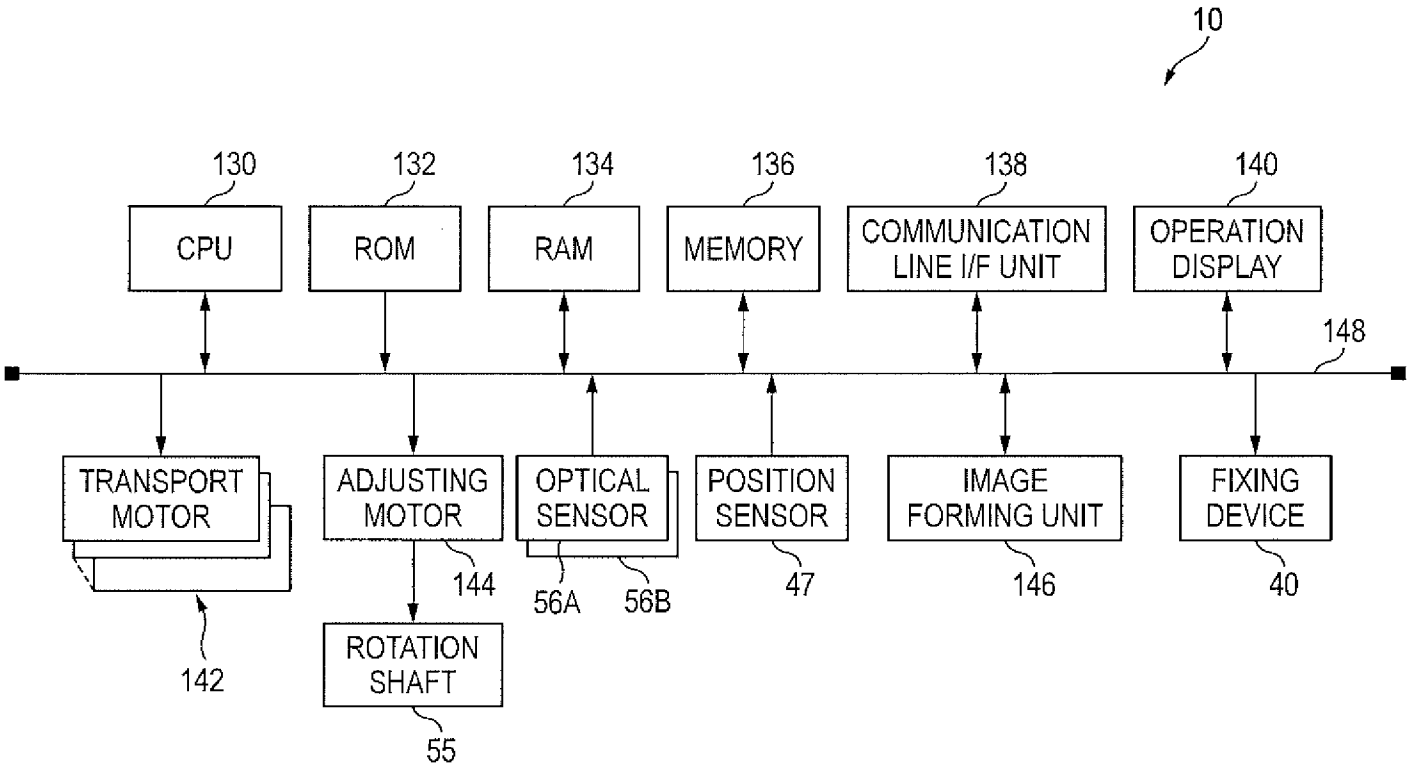
FIG. 9 is a diagram showing a configuration example of main parts of an electric system of the image forming apparatus.

As shown in FIG. 9, the image forming apparatus 10 according to the exemplary embodiment includes a central processing unit (CPU) 130 which is an example of a controller which controls overall operations of the image forming apparatus 10, and a read only memory (ROM) 132 in which various programs and various parameters are stored in advance. The image forming apparatus 10 further includes a random access memory (RAM) 134 which is used as a work area when executing various programs by the CPU 130, and a non-volatile memory 136 such as a flash memory. A timer unit which stores current time is, for example, embedded in the CPU 130.

In addition, the image forming apparatus 10, for example, includes a communication line interface (I/F) unit 138 which transmits and receives image data to and from an external apparatus connected to a communication line. The image forming apparatus 10 includes an operation display 140 as an example of a notification unit which receives instruction with respect to the image forming apparatus 10 from a user and notifies a user of various information items relating to an operation state of the image forming apparatus 10. The operation display 140, for example, includes display buttons for expressing the reception of an operation instruction by executing a program; or a display in which a touch panel is provided in a display surface on which various information items are displayed, and hardware keys such as numeric keys or a start button.

The image forming apparatus 10 includes various transport motors 142 for rotating various rolls such as the pickup roll 16, the transport roll pair 24, the registration roll pair 25, the tension rolls 27 and 29, the transport roll pairs 42 and 48, the exit roll pair 44, and the reverse roll 49 which are used in the transportation of the paper P.

The image forming apparatus 10 includes an adjusting motor 144 which rotates the rotation shaft 55 of the adjusting device 59, the optical sensors 56A and 56B, and the position sensor 47 which detects whether or not the paper P before a toner image is transferred is loaded on the transport belt 26.

The image forming apparatus 10 includes an image forming unit 146 which includes the process cartridge 28K or the like which is a configuration member for forming a toner image on the surface of the photoreceptor 30, and the fixing device 40 which fixes a toner image to the paper P by drying and pressing the toner image transferred to the paper P.

Each unit of the CPU 130, the ROM 132, the RAM 134, the memory 136, the communication line I/F unit 138, the operation display 140, the transport motor 142, the adjusting motor 144, the optical sensors 56A and 56B, the position sensor 47, the image forming unit 146, and the fixing device 40 is connected to each other through a bus 148 including an address bus, a data bus, and a control bus.

With the configuration described above, the image forming apparatus 10 according to the exemplary embodiment accesses the ROM 132, the RAM 134, and the memory 136 and transmits and receives of communication data to and from an external apparatus through the communication line I/F unit 138, by using the CPU 130. The image forming apparatus 10 acquires various instruction information items through the operation display 140 and displays various information items with respect to the operation display 140, by using the CPU 130. The image forming apparatus 10 controls the rotation of the transport motor 142 and the adjusting motor and controls the image forming unit 146 and the fixing device, by using the CPU 130. The image forming apparatus 10 acquires each of detection information of the paper P detected by the position sensor 47 and information relating to the received light detected by the optical sensors 56A and 56B, by using the CPU 130.

Next, an operation of the image forming apparatus 10 in a transfer operation will be described with reference to FIG. 10.

Figure 10:
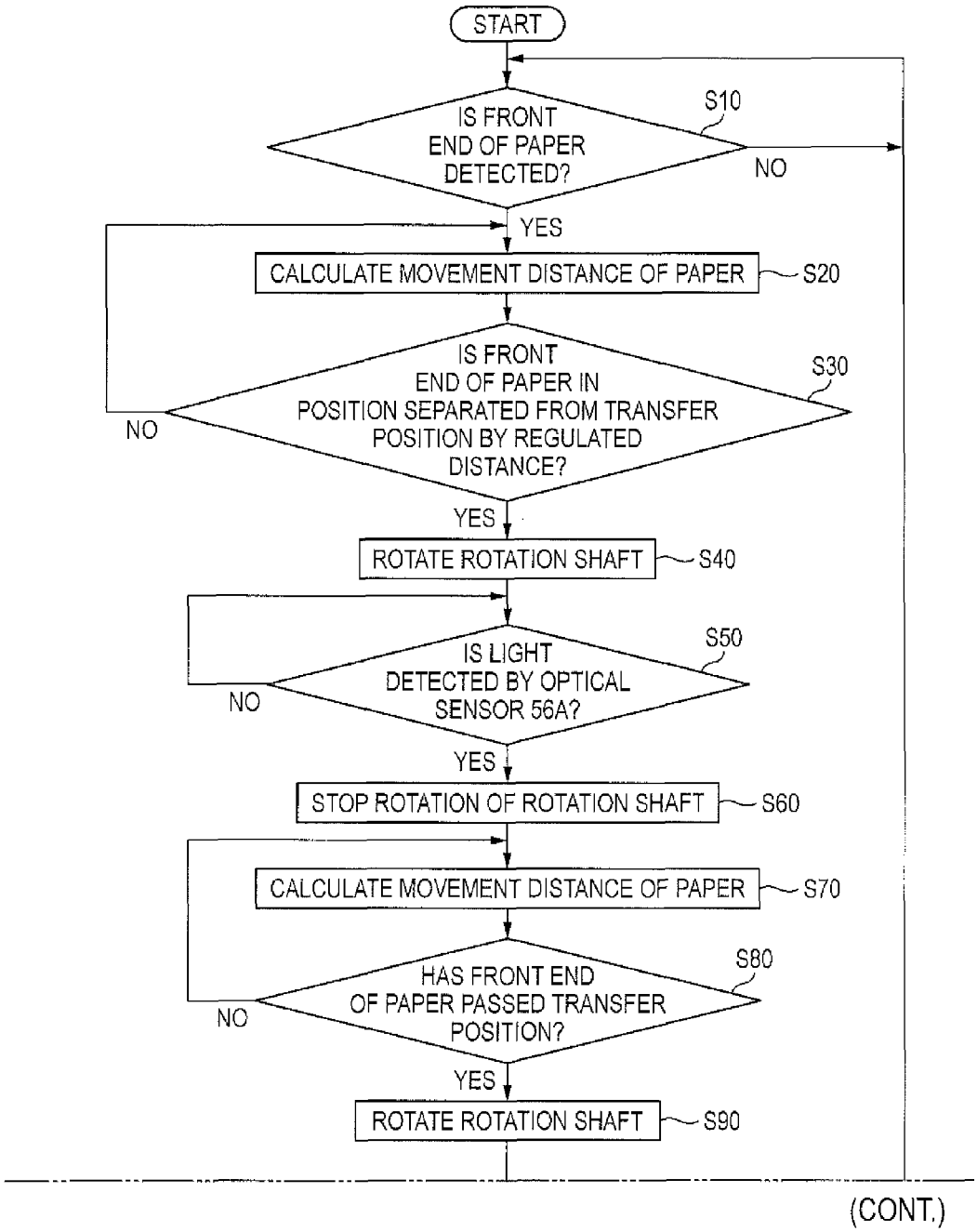
FIG. 10 is a flowchart showing an example of a flow of a transfer process.

FIG. 10 is a flowchart showing an example of a flow of a transfer process which is executed by the CPU 130, when transferring a toner image formed on the surface of the photoreceptor 30 to the paper P by the transfer roll 38. A program (transfer program) regulating the transfer process is, for example, installed in the ROM 132 in advance.

A toner image is already formed on the surface of the photoreceptor 30, and in the adjusting device 59, the second pressing position 52B of the eccentric cam 52 comes into contact with the bearing 50, and accordingly, the transfer roll 38 is set to press the photoreceptor 30 with the second pressing force.

First, in Step S10, the CPU 130 acquires an output value of the position sensor 47 and determines whether or not a front end of the paper P is detected on the transport belt 26.

The position sensor 47, for example, outputs "0" as an output value, in a case where the paper P is not present in a detection range of the position sensor 47 and outputs "1" as an output value, in a case where the paper P is present therein. Accordingly, the CPU 130 may determine that the front end of the paper P is detected, in a case where the output value of the position sensor 47 changes from "0" to "1". The output value output by the position sensor 47 is merely an example, and for example, the position sensor may output "1", in a case where the paper P is not present in a detection range of the position sensor 47 and may output "0", in a case where the paper P is present therein.

The negative determination of the determination process in Step S10 indicates a state where the paper P is not transported to the transport belt 26, and accordingly, the process returns to the process in Step S10 and the detection of the front end of the paper P is continued.

Meanwhile, in a case of the positive determination of the determination process in Step S10, the time when the front end of the paper P is detected (hereinafter, referred to as "detection time of paper P") is acquired from the timer unit included in the CPU 130, the time is stored, for example, in a predetermined area of the RAM 134, and the process proceeds to Step S20.

The detection time of the paper P may be acquired from an external apparatus such as a time server connected to the communication line via the communication line I/F unit 138, for example.

In Step S20, the CPU 130 calculates a movement distance of the paper P from the detected position of the front end of the paper P by the position sensor 47, using a transport speed of the transport belt 26 and an elapsed time from the detection time of the paper P stored in the RAM 134 in Step S10.

Specifically, the CPU 130 acquires the current time from the timer unit included in the CPU 130, acquires the detection time of the paper P from the RAM 134, and calculates the elapsed time from the detection time of the paper P. The CPU 130 calculates a distance from the detected position of the front end of the paper P by the position sensor 47 to the front end of the transported paper P by multiplying the calculated elapsed time by the transport speed of the transport belt 26.

In a case where the transport speed of the transport belt 26 changes depending on information relating to the image formation such as the type of the paper P classified by a thickness of the paper P or the size of the paper P, the transport speed of the transport belt 26 may be calculated from the information relating to the image formation which is set in the operation display 140 by a user, for example. In a case where the transport speed of the transport belt 26 is a fixed value, the transport speed may be stored in a predetermined area of the memory 136, for example.

In parallel with the process in Step S20, the transfer of a toner image formed on the surface of the photoreceptor 30 to the paper P transported to the transfer gap 36 is started by the transfer roll 38. As described above, when the paper P starts to pass through the transfer gap 36, the second pressing position 52B of the eccentric cam 52 contacts with the bearing 50, and accordingly, the pressing force of the transfer roll 38 against the photoreceptor 30 is set to be smaller than that in a case where the first pressing position 52A of the eccentric cam 52 contacts with the bearing 50.

In Step S30, the CPU 130 determines whether or not the movement distance of the paper P calculated in Step S20 satisfies a regulated distance.

This regulated distance is, for example, set to a distance between the detected position of the front end of the paper P by the position sensor 47, and a position where the front end of the paper P is moved from the transfer gap 36 by the predetermined distance L after the front end of the paper P starts to pass through the transfer gap 36. The regulated distance is, for example, set in a predetermined area of the memory 136 in advance and the CPU 130 acquires the regulated distance from the memory 136.

In a case of negative determination of the determination process in Step S30, the process returns to the process in Step S20 and the processes in Steps S20 and S30 are repeated until the movement distance of the paper P calculated in Step S20 satisfies the regulated distance.

By performing the control described above, the transfer is performed with the second pressing force which is a pressing force weaker than the first pressing force, from the time when the front end of the paper P is started to be pressed in the transfer gap 36 by the transfer roll 38 until the time when the paper P is moved in the transporting direction of the paper P by the distance L. Accordingly, compared to a case where the transfer is performed with the first pressing force, a range of the paper P which is moved upwards to the upstream side of the front end of the paper P in the transporting direction of the paper P by the distance L is hardly attached to the photoreceptor 30, and the peeling failure occurrence rate decreases.

The distance L is set so that the peeling failure occurrence rate in a case where the paper P is pressed with the second pressing force becomes equal to or less than the predetermined peeling failure occurrence rate, and the distance L is determined in advance by experiment performed by a real machine of the transfer roll 38 or a computer simulation or the like based on the design specification of the transfer roll 38. Here, as long as a peeling failure occurrence rate is equal to or less than the predetermined peeling failure occurrence rate, the peeling failure occurrence rate is assumed as a peeling failure occurrence rate with which it is assumed that there is no problems in the image forming operation of the image forming apparatus 10.

Meanwhile, in a case of the positive determination of the determination process in Step S30, that is, in a case where the front end of the paper P is moved from the transfer gap 36 by the predetermined distance L or longer, the process proceeds to Step S40.

In Step S40, the CPU 130 controls the adjusting motor 144 to rotate the rotation shaft 55 of the adjusting device 59.

In Step S50, the CPU 130 acquires the output value of the optical sensor 56A to determine whether or not the light is detected by the optical sensor 56A.

The optical sensor 56A, for example, outputs "0" as an output value, in a case where light is detected by the light receiving element of the optical sensor 56A and outputs "1" as an output value, in a case where light is not detected. Accordingly, the CPU 130 may determine that light is detected by the optical sensor 56A, in a case where "1" is acquired as the output value from the optical sensor 56A. The output value output by the optical sensor 56A is merely an example, and for example, the optical sensor may output "1", in a case where light is detected by the light receiving element of the optical sensor 56A and output "0", in a case where light is not detected.

In a case of the negative determination of the determination process in Step S50, the process in Step S50 is repeated until light is detected by the optical sensor 56A. On the other hand, in a case of the positive determination, the process proceeds to Step S60.

In Step S60, the CPU 130 controls the adjusting motor 144 to stop the rotation of the rotation shaft 55 of the adjusting device 59. By stopping the rotation of the rotation shaft 55 of the adjusting device 59 at the timing when the optical sensor 56A detects light in the process in Step S50, the first pressing position 52A of the eccentric cam 52 moves to a position to come into contact with the bearing 50. That is, after the paper P is moved from the transfer gap 36 in the transporting direction of the paper P by the distance L, the transfer is performed with the first pressing force which is a pressing force stronger than the second pressing force.

Accordingly, compared to a case where the transfer is performed with the second pressing force, the smear generation rate in a range of the paper P from the position moved upwards to the upstream side of the front end of the paper P in the transporting direction of the paper P by the distance L, to the upstream end, in the transporting direction, of the paper P (hereinafter, "rear end of the paper P") is decreased.

In Step S70, the CPU 130 calculates a movement distance of the paper P from the detected position of the front end of the paper P by the position sensor 47, in the same manner as in Step S20.

In Step S80, the CPU 130 determines whether or not the rear end of the paper P has passed through the transfer gap 36, by using the movement distance of the paper P calculated in Step S70. Specifically, the CPU 130 determines whether or not the front end of the paper P is moved from the transfer gap 36 by a length of the paper P. Here, the length of the paper P means a length thereof along the transporting direction of the paper P, and is, for example, acquired from the size of the paper P set in the operation display 140.

In a case of negative determination of the determination process in Step S80, that is, in a case where the toner image is being transferred to the paper P by the transfer roll 38 yet, the process proceeds to Step S70 and the processes in Steps S70 and S80 are repeated until the transfer to the paper P is completed. On the other hand, in a case of the positive determination of the determination process in Step S80, that is, in a case where the transfer of the toner image to the paper P by the transfer roll 38 is completed, the process proceeds to Step S90.

In Step S90, the CPU 130 controls the adjusting motor 144 to rotate the rotation shaft 55 of the adjusting device 59.

In Step S100, the CPU 130 executes the same process as the process sin Step S50 and determines whether or not light is detected by the optical sensor 56B.

In a case of the negative determination of the determination process in Step S100, the process in Step S100 is repeated until light is detected by the optical sensor 56B. On the other hand, in a case of the positive determination of the determination process, the process proceeds to Step S110.

In Step S110, the CPU 130 controls the adjusting motor 144 to stop the rotation of the rotation shaft 55 of the adjusting device 59. By stopping the rotation of the rotation shaft 55 of the adjusting device 59 at the timing when the optical sensor 56B detects light in the process in Step S100, the second pressing position 52B of the eccentric cam 52 moves to a position to come into contact with the bearing 50. That is, the pressing force of the transfer roll 38 against the photoreceptor 30 in a case where the front end of the next paper P is transported to the transfer gap 36 is set to the second pressing force.

In Step S120, the CPU 130 determines whether or not the transfer of the toner image instructed by a user is completed.

In a case of negative determination of the determination process in Step S120, the process proceeds to Step S10 and is on standby until the next paper P which is a transfer target of a toner image is transported onto the transport belt 26. In a case where the front end of the paper P is detected in the process in Step S10, the CPU 130 executes the processes in Steps S20 to S120 described above, to continuously transfer the toner image to the paper P while changing the pressing force of the transfer roll 38 against the photoreceptor 30.

Meanwhile, in a case of the positive determination of the determination process in Step S120, the transfer process shown in FIG. 10 ends.

Figure 11:
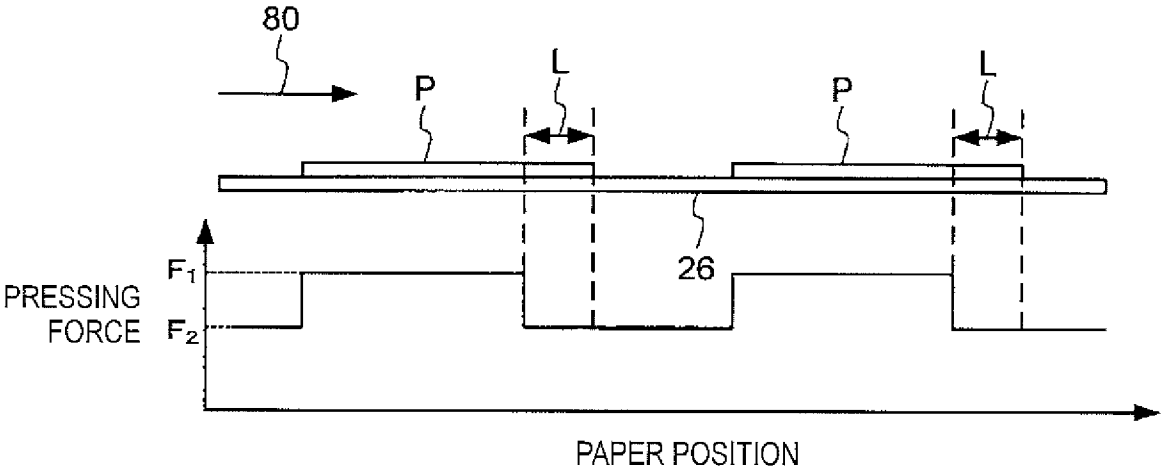
FIG. 11 is a schematic view showing a relationship between a position of paper and a pressing force.

FIG. 11 is a diagram showing a relationship between a paper position of the paper P and the pressing force in a case where the transfer process shown in FIG. 10 is executed.

As shown in FIG. 11, according to the image forming apparatus 10 according to the exemplary embodiment, a range of the paper P which is moved toward the upstream side of the front end of the paper P in the transporting direction of the paper P by the distance L is pressed by the transfer roll 38 with the second pressing force F2 which is weaker than the first pressing force F1 to perform the transfer of the toner image formed on the photoreceptor 30. Meanwhile, a range of the paper P after the front end of the paper P is moved from the transfer gap 36 in the transporting direction of the paper P by the distance L is pressed by the transfer roll 38 with the first pressing force F1 which is stronger than the second pressing force F2 to perform the transfer of the toner image formed on the photoreceptor 30.

Therefore, the image forming apparatus 10 decreases the peeling failure occurrence rate of the paper P and the smear generation rate of the paper P.

As the thickness of the paper P decreases, rigidity of the paper P showing a degree of bendability of the paper P in a case where a pressing force is applied to the paper P decreases. That is, as the thickness of the paper P decreases, the paper P tends to be easily attached to the photoreceptor 30 at the time of the transfer operation. Accordingly, as the thickness of the paper P decreases, it is preferable to set the distance L longer. By setting the distance L as described above, the paper P is hardly attached to the photoreceptor 30 and the peeling angle of the paper P is controlled to be in a predetermined range.

In a case where the thickness of the paper P is equal to or greater than a regulated thickness, the rigidity of the paper P also increases in accordance thereto. Accordingly, it is considered that the paper P is hardly attached to the photoreceptor 30, even when the toner image is transferred to the paper P over the front end to the rear end, while fixing the pressing force of the transfer roll 38 against the photoreceptor 30 at the first pressing force. Accordingly, in a case where the thickness of the paper P is less than the thickness (for example, a basis weight of the paper P is less than 50 [g/m2]) so as to obtain equal to or greater than the predetermined peeling failure occurrence rate, the transfer process shown in FIG. 10 of changing the pressing force of the transfer roll 38 against photoreceptor 30 in a different part of the paper P may be executed.

As described above, after the toner image is transferred to the paper P by the transfer roll 38, the toner image transferred to the paper P is fixed onto the paper P by the fixing device 40. At this time, the fixing device 40 heats the toner image while nipping the paper P in contact portions formed with a roll pair included in the fixing device 40 to fix the toner image to the paper P.

In this case, when the thickness of the paper P is equal to or greater than a predetermined thickness, the paper P is difficult to be inserted between the contact portions. Accordingly, when the paper P having a thickness equal to or greater than a predetermined thickness is transported to the fixing device 40, the front end of the paper P collides with the roll pair forming the contact portions of the fixing device 40 once, and then the paper P is drawn into the rotation of the roll pair of the fixing device 40 and interposed between the contact portions of the fixing device 40.

When the paper P collides with the roll pair of the fixing device 40, paper deviation in which the paper P is deviated to the upstream side in the transporting direction due to an impact of collision occurs. At that time, when the toner image is transferred to the paper P having the front end collided with the roll pair of the fixing device 40 by the transfer roll 38, the paper P is rubbed with the photoreceptor 30 due to the paper deviation in the transfer gap 36, and thus, quality of an image may be deteriorated.

Accordingly, in the adjusting device 59, when the pressing force of the transfer roll 38 against the photoreceptor 30 is set to a pressing force stronger than the first pressing force at the timing when the front end of the paper P having a thickness equal to or greater than a predetermined thickness (for example, a basis weight of the paper P is equal to or greater than 100 [g/m2]) approaches the contact portions of the fixing device 40, the paper deviation is prevented.

In this case, the shape of the eccentric cam 52 is changed to a shape having a point (for example, a third pressing position) where a distance from the center of the eccentric cam 52 is longer than the first pressing position 52A, in addition to the first pressing position 52A and the second pressing position 52B. An optical sensor and a light shielding plate corresponding to the third pressing position are added to the adjusting device 59. The light shielding plate added is attached to the rotation shaft 55 of the adjusting device 59 so that light is detected by the optical sensor added in a case where the third pressing position of the eccentric cam 52 comes into contact with the bearing 50 and the optical sensor added does not detect light in other cases.

The image forming apparatus 10 calculates a movement distance of the paper P by the same process as in Step S20 of FIG. 10, and the rotation shaft 55 of the adjusting device 59 may rotate so that the third pressing position comes to contact with the bearing 50 at the timing when the front end of the paper P approaches the contact portions of the fixing device 40.

As shown in FIG. 4, the back surface peeling failure occurrence rate tends to increase more than the front surface peeling failure occurrence rate. Accordingly, it is preferable to set the distance L in a case of transferring a toner image to the back surface of the paper P to which a toner image is transferred to one image formation surface, to be longer than the distance L used when transferring a toner image to one image formation surface. As described above, by setting the distances L from the front end of the paper P where the transfer is performed with the second pressing force to be different for each image formation surface, the peeling angle of the paper P in a case where the toner is transferred to the back surface of the paper P further decreases and the peeling angle of the paper P is controlled to be in the predetermined range.

Since the back surface peeling failure occurrence rate tends to increase more than the front surface peeling failure occurrence rate, the transfer process shown in FIG. 10 may be applied to only in a case of transferring a toner image to the back surface of the paper P, in a case of performing duplex printing in the image forming apparatus 10.

Figure 12:
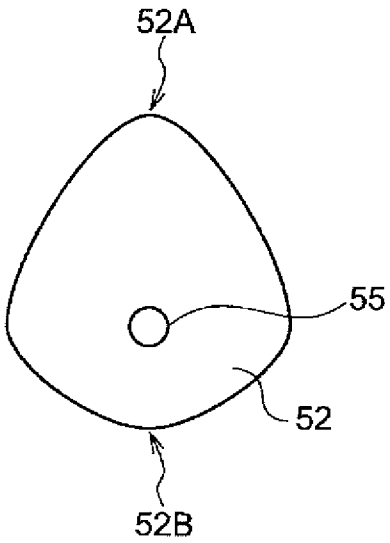
FIG. 12 is a diagram showing an example of a shape of the eccentric cam.

The shape of the eccentric cam 52 of the adjusting device 59 shown in FIG. 7 is merely an example and there is no limitation. The shape of the eccentric cam 52 may be any shape, as long as it is a shape so as to have different distances from the position through which the rotation shaft 55 penetrates to the end of the eccentric cam 52, or may be substantially a rhombic shape having round corners, as shown in FIG. 12, for example.

Hereinabove, the invention has been described using the exemplary embodiments, but the invention is not limited to the range described in the exemplary embodiments. Various modifications or improvement can be performed in the exemplary embodiment within a range not departing from the gist of the invention, and the modified and improved embodiments are also included in the technical scope of the invention. The order of the processes may be changed within a range not departing from the gist of the invention, for example.

The invention may be, for example, applied to a transfer operation of an image forming apparatus using a direct transfer belt (DTB) system of forming an image having a full-color quality. In an image forming apparatus corresponding to full-color system using the DTB system, process cartridges corresponding to each color of cyan, magenta, and yellow are disposed to oppose the transport belt 26, in addition to the process cartridge 28K corresponding to black. When transferring a toner image having each color to the paper P by the transfer roll, the transfer process shown in FIG. 10 is executed.

In the exemplary embodiment, the transfer program has been installed in the ROM 132, but there is no limitation. The transfer program according to the invention can be provided in a state of being recorded in a computer-readable recording medium. For example, the transfer program according to the invention can be provided in a state of being recorded in a portable recording medium such as a compact disc (CD)-ROM, a DVD (digital versatile)-ROM, or a universal serial bus (USB). In addition, the transfer program according to the invention can be provided in a state of being recorded in a semiconductor memory such as a flash memory.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transport belt that contacts with a photoreceptor including a surface on which a toner image is formed, and transports a recording medium;

a transfer roll that transfers the toner image formed on the surface of the photoreceptor to the recording medium while pressing the recording medium to the photoreceptor through the transport belt;

an adjusting unit that adjusts a pressing force of the transfer roll against the recording medium; and a controller that controls the adjusting unit so that a first pressing force is stronger than a second pressing force, wherein the first pressing force is the pressing force after the recording medium starts to pass through a transfer position of the transfer roll and is moved by a predetermined distance, the second pressing force is the pressing force when the recording medium starts to pass through the transfer position, and the controller sets the predetermined distance to be longer as a thickness of the recording medium decreases.

2. The transfer device according to claim 1, wherein in a case where the thickness of the recording medium is less than a predetermined thickness, the controller controls the adjusting unit so that the first pressing force is stronger than the second pressing force.

3. The transfer device according to claim 2, wherein when the toner image is transferred to one image formation surface of the recording medium having the other image formation surface on which the toner image is already transferred, the controller sets the predetermined distance to be longer than the predetermined distance in a case where the toner image is not transferred to any of the image formation surfaces of the recording medium.

4. The transfer device according to claim 2, wherein when the toner image is transferred to one image formation surface of the recording medium having the other image formation surface on which the toner image is already transferred, the controller controls the adjusting unit so that the first pressing force is stronger than the second pressing force.

5. The transfer device according to claim 1, wherein in a case where an downstream end, in a transporting direction, of the recording medium having a thickness equal to or greater than a predetermined thickness approaches a fixing device that fixes the toner image to the recording medium, the controller controls the adjusting unit so that the recording medium is pressed to the photoreceptor with a third pressing force which is stronger than the first pressing force.

6. The transfer device according to claim 5, wherein when the toner image is transferred to one image formation surface of the recording medium having the other image formation surface on which the toner image is already transferred, the controller sets the predetermined distance to be longer than the predetermined distance in a case where the toner image is not transferred to any of the image formation surfaces of the recording medium.

7. The transfer device according to claim 5, wherein when the toner image is transferred to one image formation surface of the recording medium having the other image formation surface on which the toner image is already transferred, the controller controls the adjusting unit so that the first pressing force is stronger than the second pressing force.

8. The transfer device according to claim 1, wherein when the toner image is transferred to one image formation surface of the recording medium having the other image formation surface on which the toner image is already transferred, the controller sets the predetermined distance to be longer than the predetermined distance in a case where the toner image is not transferred to any of the image formation surfaces of the recording medium.

9. The transfer device according to claim 1, wherein when the toner image is transferred to one image formation surface of the recording medium having the other image formation surface on which the toner image is already transferred, the controller controls the adjusting unit so that the first pressing force is stronger than the second pressing force.

10. A non-transitory computer readable medium storing a transfer program causing a computer to function as:

the controller according to claim 1.

11. An image forming apparatus comprising:

an image forming unit that forms a toner image on a photoreceptor;

the transfer device according to claim 1 that transfers the toner image to a recording medium; and a fixing device that fixes the toner image transferred to the recording medium by the transfer device to the recording medium.

12. A transfer method comprising:

contacting a transport belt with a photoreceptor including a surface on which a toner image is formed;

transporting a recording medium;

transferring the toner image formed on the surface of the photoreceptor to the recording medium while pressing the recording medium to the photoreceptor through the transport belt;

adjusting a pressing force of a transfer roll against the recording medium; and controlling the pressing force of the transfer roll so that a first pressing force is stronger than a second pressing force, wherein the first pressing force is the pressing force after the recording medium starts to pass through a transfer position of the transfer roll and is moved by a predetermined distance, the second pressing force is the pressing force when the recording medium starts to pass through the transfer position, and the predetermined distance is set to be longer as a thickness of the recording medium decreases.

* * * * *